United States Patent [19]

Kleber

[11] Patent Number: 4,494,683

[45] Date of Patent: Jan. 22, 1985

[54] STEAM KILN

[76] Inventor: Kurt Kleber, Zum Mühlgraben 4, 6842 Bürstadt, Fed. Rep. of Germany

[21] Appl. No.: 426,172

[22] Filed: Sep. 28, 1982

[30] Foreign Application Priority Data

Oct. 5, 1981 [DE] Fed. Rep. of Germany ..... 3143907

[51] Int. Cl.[3] ..... D06C 7/02; A41H 43/00

[52] U.S. Cl. ..... 223/51; 223/70; 223/73

[58] Field of Search ..... 223/70, 73, 76, 28, 223/51; 34/201, 204, 218, 219, 195, 196

[56] References Cited

U.S. PATENT DOCUMENTS

| | | | |
|---|---|---|---|
| 486,739 | 11/1892 | Schaefer | 223/51 X |
| 2,572,893 | 10/1951 | Richter | 223/51 X |
| 2,957,067 | 10/1960 | Scofield | 34/219 X |
| 2,966,573 | 12/1960 | Hansen | 34/219 X |
| 3,253,349 | 5/1966 | Jarkow | 223/73 X |
| 3,330,451 | 7/1967 | Gordon | 223/51 |
| 3,765,580 | 10/1973 | Wilsker et al. | 223/52 |

*Primary Examiner*—Werner H. Schroeder
*Assistant Examiner*—Judith L. Kravitz

[57] ABSTRACT

A steam kiln (10) for the setting of pleats in fabrics. The steam kiln (10) has shielding walls (32, 40) disposed at a distance from the lateral inside walls (26) and from the roof (22). These shielding walls form an integrated system of air guiding chambers (34, 42) for the return of steam aspirated by a fan (46) through an opening (44) in the horizontal top shield (40) from the interior of the kiln into the bottom area of the kiln interior. Heating elements (28) are provided in the air guiding chambers (34) for the reheating and superheating of the steam atmosphere. The steam is injected into the bottom part of the steam kiln from an external steam source (54).

8 Claims, 3 Drawing Figures

STEAM KILN

BACKGROUND OF THE INVENTION

The invention relates to a steam kiln for the permanent setting of creases in fabrics provided with previously laid folds, consisting of a cabinet provided with a tightly sealing loading door and having heating elements in its interior for the reheating of steam injected into the cabinet interior.

In such steamers, the pieces of fabric which are later to be made into pleated skirts, for example, are treated with steam, being folded and clamped in so-called pleating molds. By the steam treatment and subsequent cooling the pleats are permanently set in the pieces of fabric and they can then be made into skirts. Other patterns of pleats created with pleating molds or by machinery in webs of fabric are set by means of steamers of the kind described. The heating of the steamers is performed usually by means of electrical resistance heating elements disposed in the interior of the cabinet, while a heated water pan integral with the cabinet is provided in the latter for the production of steam. If desired, a connection can also be made to an external steam generator, if one is available, such as one being used in conjunction with a steam pressing machine for example.

The known steamers have a high energy consumption which is to be attributed not only to high radiation loss due to insufficient thermal insulation, but also to the fact, among others, that, when the cabinet is loaded, the pleating molds or machine-pleated rolls of fabric have to be arranged individually in the cabinet or removed individually after steaming. A large part of the heat and steam produced in the preceding steaming cycle then escapes through the loading door when it is opened. It has furthermore been observed that during the steaming process different temperatures establish themselves at different levels in the cabinet, i.e., a temperature gradient occurs. The heat input must then, however, be adjusted such that the lowest temperature produced in the cabinet is sufficiently high so as to assure a perfect setting of the pleats. The resistance heating elements serving to heat the cabinets are operated during certain phases of operation of the cabinet at such temperatures that they are incandescent. Although the heating elements in the known cabinets are disposed preferably only in the upper part of the interior space, it can happen, if the loading is not performed carefully, that the fabrics will be singed or at least overheated by the incandescent heating elements, and it is essential to avoid this in the case of the modern synthetic fibers used in the fabrics especially designed for such pleating.

It is the object of the invention to create an improved steam kiln which will offer substantial energy savings simpler and quicker charging, as well as a more uniform heating of the cabinet interior. At the same time, the danger of excessively low or high steam temperatures in individual areas of the cabinet is to be reliably prevented.

SUMMARY OF THE INVENTION

Setting out from a steam kiln of the kind mentioned above, this object is achieved by the invention in that the heating elements are disposed at least on the two lateral inner walls of the steam kiln, and a shielding wall forms an air guiding chamber with each inside wall bearing the heating elements, and terminates slightly above the floor of the kiln, that a shield forming a horizontal air guiding chamber communicating with the vertical air guiding chambers is provided at a distance below the top of the kiln interior and has an aperture for the admission of the steam contained in the kiln, and that in the air guiding chamber formed at the top of the kiln there is provided a circulating blower whose intake side is connected to the entrance aperture and whose discharge side communicates with the horizontal air guiding chamber.

The heating elements disposed in the vertical air guiding chambers therefore are no longer exposed in the kiln interior, so that any burning or singeing of the charge by direct contact with the heating elements is impossible. The circulating blower, which in the simplest case is a fan disposed in the horizontal shield circulates the steam constantly in the kiln interior, in such a manner that the steam contained in the kiln is aspirated into the horizontal air guiding chamber at the roof of the kiln and is forced from thence into the vertical air guiding chambers. The steam then flows downward in the vertical guiding chambers, being simultaneously heated by the heating elements, until it finally emerges into the kiln interior at the kiln floor. With this continuous forced circulation of the steam by the blower, a uniform temperature distribution in the kiln interior is assured, along with an intensive action of steam on the material. The positive guidance of the steam along the heating elements in the vertical air guiding chambers also assures a good transfer of the thermal energy produced by the heating elements to the steam that flows over them.

The outside and inside walls including the floor and roof of the steam kiln are best made of sheet metal, preferably of corrosion-resistant high-grade steel, the space between the outside and inside walls being filled with a sufficient thickness of thermal insulating material. This reduces energy losses due to thermal conduction and radiation, which has the advantage, in addition to the desired saving of energy, that the temperature in the room in which the kiln is installed does not rise excessively, i.e., a tolerable room temperature can be maintained for the personnel working in the vicinity of the steam kiln. It is preferable to provide a shallow trough-like recess in the floor of the kiln to collect any steam condensate, and within the recess to provide a steam feeding means which is provided with steam apertures and is connectable to a preferably external steam source.

The steam feeding means is best constituted by a steam feed pipe provided with steam apertures in the form of a plurality of bores and disposed approximately centrally between and parallel to the side walls of the steam kiln, within the floor recess. The steam therefore enters at the floor of the steam kiln and there immediately mixes with the recirculated steam which also emerges at the floor and which has been reheated in the vertical air guiding chambers. Thus the still moist steam is immediately heated and thus dried, so that virtually no condensate forms during the operation of the steam kiln.

The mixing of the steam delivered by the steam generator with the reheated circulated steam is further improved if the bores forming the steam entry orifices are disposed on opposite sides of the steam feed pipe and point horizontally toward the adjacent side walls, because then the fresh steam and the recirculated steam are aimed directly one against the other.

The floor is desirably provided with tracks for the wheels of a charging car, and at the door end of these tracks, ramps are provided which can be raised into the interior of the kiln and lowered onto the floor in front of the kiln when the door is opened. The charging of the kiln, therefore, is no longer accomplished by the individual placement of the pleating molds or rolls of machine pleated material, and instead the car, already loaded outside of the kiln, is rolled into the kiln. As a result, the charging door needs to be opened only for the very brief time needed for the introduction and removal of the loaded car, thereby considerably reducing the loss of heat and steam through the opened door.

The floor and side walls of the car, which is open at the top for loading with the materials to be steamed, are best made of wire screening material of sufficient stiffness, so that the steam can flow unhampered through the charging car.

It is desirable to associate at least two charging cars with each steam kiln, so that the second charging car can be loaded with the material while the first is being steam treated. The changing of the charging cars can then be accomplished in a few seconds.

BRIEF DESCRIPTION OF THE DRAWING

The invention will be further explained in the description that follows of an embodiment, in conjunction with the drawing, wherein.

DETAILED DESCRIPTION OF A PREFERRED EMBODIMENT

Figure 1:
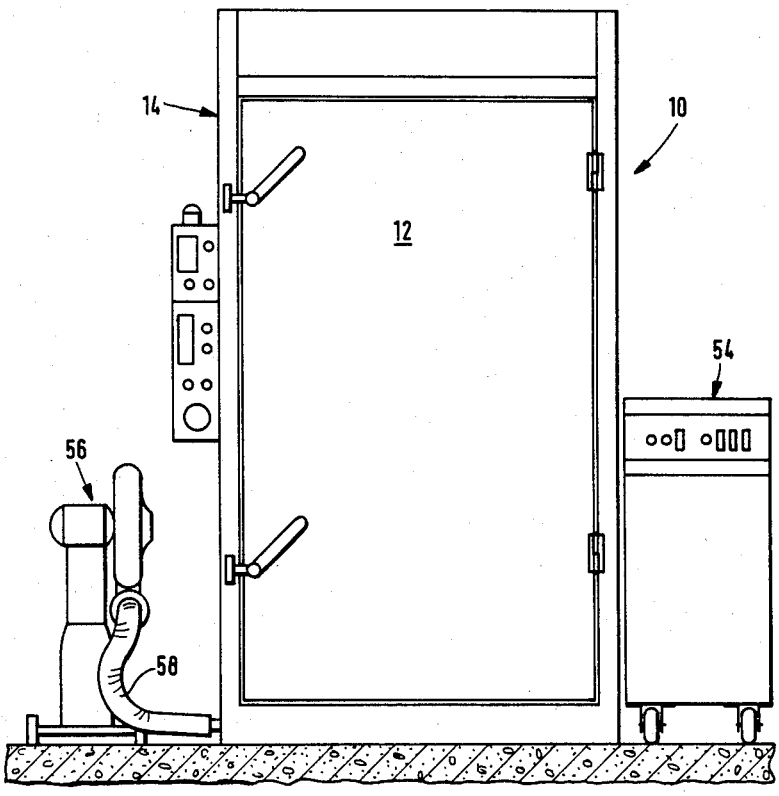
FIG. 1 is a front elevation of a steam kiln in accordance with the invention.

The steam kiln shown in the drawings and designated as a whole by the number 10, has a carcass 14 which can be closed by a flush charging door 12 on its front side. Its lateral walls 16 and back wall 18, as well as the floor 20 and the roof 22 are of double-wall construction, filled with thermal insulating material 24. The outside and inside walls of the kiln 14 are also made of corrosion-resistant sheet steel, as are the front and back walls of the charging door 12, which contain thermal insulating material 24 to guard against heat losses from the kiln interior. Electrical resistance heating elements are mounted on the sheet steel inside walls 26 of the sides 16, and are shielded off from the kiln chamber 30 by vertical shielding walls 32 or corrosion-resistant sheet steel disposed parallel to the inside walls at a slight distance away from the heating elements. Thus, vertical air guiding chambers 34 are formed between the inside walls 26 and the shielding walls 32. Since the shielding walls 32 are not brought all the way to the floor 36, the vertical air guiding chambers 34 have each an aperture 38 extending just above the floor 20 over the entire depth of the inner chamber 30 of the kiln, and saturated steam contained in the air guiding chambers and superheated by the heating elements 28 can pass through these apertures into the kiln interior 30.

At a distance below and parallel with the roof 22 of the kiln there is also disposed a shield 40 of sheet steel extending all the way to the top edges of the vertical shielding walls 32 and joined thereto. The air guiding chamber 42 formed between the roof 22 and the shield 40 thus communicates with the air guiding chambers 34 formed on the inner side walls 26. Approximately in the center of the roof shield 40 there is provided a circularly defined entry aperture 44 in which a fan 46 is disposed, which aspirates the steam-saturated atmosphere from the chamber interior and blows it into the air guiding chamber 42. Since the latter communicates with the vertical air guiding chambers 34, the injected atmosphere is therefore forced, when the fan is turned on, into the vertical air guiding chambers, passes over the heating elements 26, and then emerges at the bottom through the apertures 38 into the interior 30 of the kiln. The entire atmosphere is therefore constantly recirculated, thus making the temperature uniform in the kiln interior 30. The temperature of the atmosphere in the kiln is controlled by a thermostat (not shown) connected to a temperature sensor disposed in the kiln interior and controlling the heating elements.

The floor 36 is provided in its center with a shallow, trough-like recess 48 into which a steam feed pipe 50 is brought through the back wall 18. The steam feed pipe is provided with a plurality of steam orifices 52, all aimed horizontally toward the adjacent lateral walls 16. The steam feed pipe 50 is connected to an external steam generator, for example the electrical steam generator 54 represented on the right beside the steam kiln in FIG. 1. The output of the steam generator is designed to be such that even two or more steam kilns 10 can be supplied with the necessary amount of steam in case of necessity. If other steam sources, such as the steam generator of a pressing machine is available at the site, they can of course be connected to the steam supply tube 50 instead of the steam generator 54.

If the steam kiln 10 is installed in small workrooms, it is desirable to release the steam from the kiln into the outside atmosphere at the end of the steaming cycle before opening the charging door 12. The hot air blower 56 represented in FIG. 1 on the left beside the steam kiln 10 can be used for this purpose, injecting hot air through a hose 58 and a hot air passage 60 through the bottom of the kiln into the interior of the kiln. The steam displaced by the injected hot air is then exhausted through an exhaust passage 62 (FIG. 2), which can best be provided in the upper part of the kiln 10, for example in its back wall 18 or its roof 22, and which, like the hot air passage 60, can be opened and closed by a damper as desired.

Figure 2:
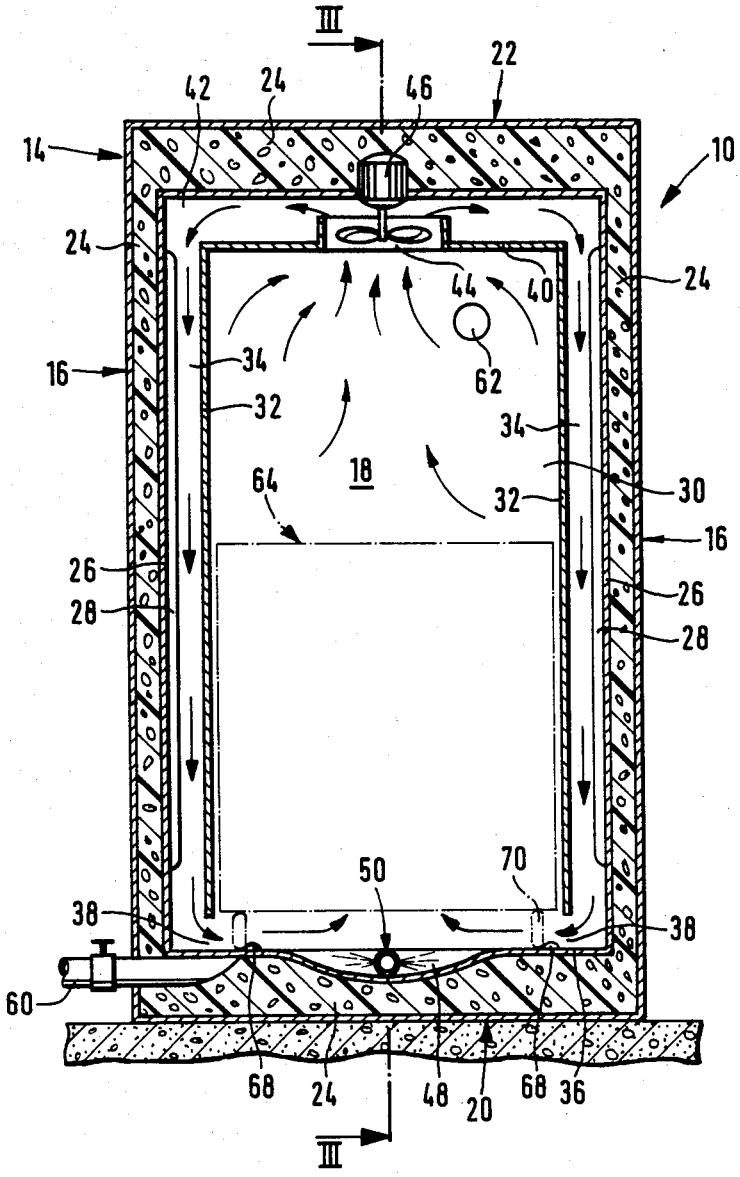
FIG. 2 is a cross section through the steam kiln of the invention, as seen in the direction of the arrows 2—2 of FIG. 3.
Figure 3:
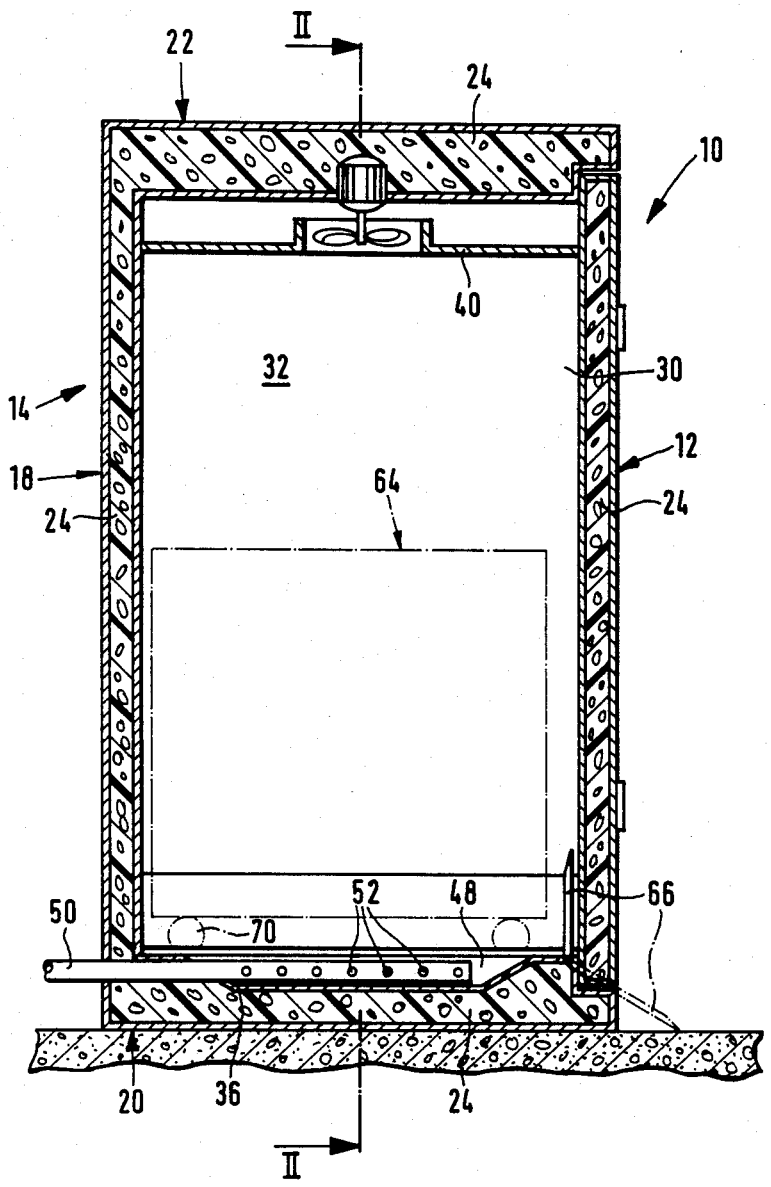
FIG. 3 is a cross section through the steam kiln of the invention, as seen in the direction of the arrows 3—3 of FIG. 2.

In order to shorten the time during which the charging door 12 is held open during the unloading and loading of the steam kiln 10 and thus minimize the heat and steam losses through the open door, the kiln is provided with a charging car 64 having a width and depth corresponding approximately to the free space within the kiln. Before this car is placed in the kiln, it is charged with the material to be steamed. The charging car 64 indicated by broken lines in the interior of the kiln in FIGS. 2 and 3 is a conventional wheeled car made with metal wire mesh which permits the steam to flow unhampered through the material stacked in the charging car. It is desirable to provide at least two charging cars 64 for each steam kiln, so that they can then be used alternately, i.e., the second car can be prepared and filled with the material that is to be steamed in the next steaming operation while the first car is still inside the kiln.

To facilitate the loading of the car 64 into the interior of the kiln, ramps 66 are provided directly behind the charging door 12 at the front edge of the bottom 36. These ramps can be folded up into the interior of the kiln to close the door, and when the door is opened they can be lowered onto the floor in front of the kiln, and then they guide the wheels 70 of the car 64 into the tracks 68 running laterally alongside the floor recess 48.

I claim:

1. A steam kiln for setting of folds of fabrics previously provided with folds, by means of heated steam, comprising: a housing having an interior with a top wall, a bottom wall, a front wall, a back wall, and two side walls, a sealing charging door in said front wall, and heating elements in the housing interior for reheating steam brought into the kiln interior, said heating elements being disposed on said two side walls, first shielding walls disposed at a distance from the heating elements and from each of said side walls so as to form two air guiding chambers extending essentially vertically along said side walls and terminating slightly above said bottom wall; a second shielding wall disposed at a distance below said top wall, an entry aperture in said second shielding wall for the steam contained in the steam kiln and forming with said top wall a horizontal air guiding chamber communicating with said vertical air guiding chambers, a blower arranged in said horizontal air guiding chamber and having an intake connected to said entry aperture and a discharge communicating with said horizontal air guiding chamber, said bottom having a shallow, trough-like recess for the collection of steam condensate, and a steam feed system adapted to be connected to a steam source and provided in said recess and having orifices.

2. A steam kiln according to claim 1, wherein said housing also has outside walls, said interior and outside walls being of sheet metal, there being a space between said outside walls and said interior walls which space is filled with thermal insulating material.

3. A steam kiln according to claim 2, wherein the outside and the interior walls and said shielding walls are made of corrosion-resistant high-grade steel sheet material.

4. A steam kiln according to claim 1, wherein steam feed system comprises a steam feed tube with a plurality of bores forming said orifices and being disposed in said recess approximately centrally between and parallel to said two side walls of said steam kiln.

5. A steam kiln according to claim 4, wherein said bores are disposed on opposite sides of said steam feed tube, each being aimed horizontally at the adjacent side wall.

6. A steam kiln according to claim 4, wherein said bottom wall is provided with tracks for wheels of a charging car, said tracks ending at said door, and ramps at said door end adapted to be folded up into the interior of the steam kiln and to be lowered onto a floor in front of the steam kiln when the door is open.

7. A steam kiln according to claim 6, in combination with at least one charging car for charging said kiln.

8. A steam kiln according to claim 7, wherein said charging car has bottom and side walls of wire mesh material of sufficient stiffness, and being open at the top for charging with materials to be steamed.

* * * * *